US010640334B2

(12) United States Patent
Kawabuchi et al.

(10) Patent No.: US 10,640,334 B2
(45) Date of Patent: May 5, 2020

(54) ACTUATOR CONTROL DEVICE AND WORK VEHICLE

(71) Applicant: TADANO LTD., Kagawa (JP)

(72) Inventors: Naoto Kawabuchi, Kagawa (JP); Naofumi Yoshida, Kagawa (JP); Naotaka Masuda, Kagawa (JP); Yasuhiro Fukumori, Kagawa (JP)

(73) Assignee: TADANO LTD., Kagawa (JP)

( * ) Notice: Subject to any disclaimer, the term of this patent is extended or adjusted under 35 U.S.C. 154(b) by 239 days.

(21) Appl. No.: 15/549,981

(22) PCT Filed: Sep. 29, 2015

(86) PCT No.: PCT/JP2015/077419
§ 371 (c)(1),
(2) Date: Aug. 9, 2017

(87) PCT Pub. No.: WO2016/129143
PCT Pub. Date: Aug. 18, 2016

(65) Prior Publication Data

US 2018/0044143 A1 Feb. 15, 2018

(30) Foreign Application Priority Data

Feb. 13, 2015 (JP) ..... 2015-026849

(51) Int. Cl.
*B66C 13/20* (2006.01)
*G05G 7/04* (2006.01)
(Continued)

(52) U.S. Cl.
CPC ..... *B66C 13/20* (2013.01); *B66C 13/18* (2013.01); *B66C 23/36* (2013.01); *E02F 9/2012* (2013.01);
(Continued)

(58) Field of Classification Search
None
See application file for complete search history.

(56) References Cited

U.S. PATENT DOCUMENTS 5,085,071 A * 2/1992 Mizushina ..... G01M 13/025 73/115.02
6,287,237 B1 * 9/2001 Graf ..... B60W 10/06 477/107
(Continued)

FOREIGN PATENT DOCUMENTS

JP H0398484 A 4/1991
JP 2810437 B2 10/1998
(Continued)

OTHER PUBLICATIONS

International Search Report Issued in PCT/JP2015/077419, dated Dec. 8, 2015.
(Continued)

*Primary Examiner* — Nicholas K Wiltey
(74) *Attorney, Agent, or Firm* — Marshall, Gerstein & Borun LLP

(57) ABSTRACT

An actuator control device performs a reception process in which designations of a minimum operation amount and maximum operation amount of an operation unit for driving an actuator, and a maximum driving speed which is the actuator driving speed corresponding to the maximum operation amount are received. It also performs a determination process in which a function representing a characteristic line that links a first point, which corresponds to the minimum operation amount and the driving speed of 0, and a second point, which corresponds to the maximum operation amount and the maximum driving speed, is stored in a storage unit as a drive control characteristic and a drive control process in which, in response to operation of the operation unit, the actuator is driven at a driving speed
(Continued)

corresponding to the operation amount specified by the drive control characteristic stored in the storage unit.

3 Claims, 8 Drawing Sheets

(51) Int. Cl.

| | |
|---|---|
| ***F15B 11/02*** | (2006.01) |
| ***F15B 21/08*** | (2006.01) |
| ***E02F 9/20*** | (2006.01) |
| ***E02F 9/22*** | (2006.01) |
| ***F15B 19/00*** | (2006.01) |
| ***B66C 13/18*** | (2006.01) |
| ***B66C 23/36*** | (2006.01) |
| ***B66C 13/56*** | (2006.01) |
| ***B66C 23/00*** | (2006.01) |

(52) U.S. Cl.

CPC ..... *E02F 9/2253* (2013.01); *F15B 11/02* (2013.01); *F15B 19/002* (2013.01); *F15B 21/082* (2013.01); *F15B 21/087* (2013.01); *G05G 7/04* (2013.01); *B66C 13/56* (2013.01); *B66C 23/54* (2013.01); *F15B 2211/30525* (2013.01); *F15B 2211/3144* (2013.01); *F15B 2211/327* (2013.01); *F15B 2211/50554* (2013.01); *F15B 2211/5151* (2013.01); *F15B 2211/6346* (2013.01); *F15B 2211/665* (2013.01); *F15B 2211/6654* (2013.01); *F15B 2211/6658* (2013.01); *F15B 2211/75* (2013.01)

(56) References Cited

U.S. PATENT DOCUMENTS

| | | | | |
|---|---|---|---|---|
| 6,330,502 | B1 | 12/2001 | Cetinkunt et al. | |
| 7,210,292 | B2 * | 5/2007 | Price | E02F 9/2025 60/426 |
| 7,856,301 | B2 * | 12/2010 | Sjogren | E02F 3/96 701/50 |
| 9,644,650 | B2 * | 5/2017 | Kim | F15B 19/002 |
| 2002/0157712 | A1 | 10/2002 | Hou et al. | |
| 2011/0000203 | A1 * | 1/2011 | Riedel | F15B 11/163 60/327 |
| 2014/0230643 | A1 * | 8/2014 | Kim | E02F 9/2271 91/1 |
| 2016/0228889 | A1 * | 8/2016 | Maruyama | F16K 31/0651 |

FOREIGN PATENT DOCUMENTS

| | | | |
|---|---|---|---|
| JP | 2003-300693 | A | 10/2003 |
| JP | 4243329 | B2 | 3/2009 |
| JP | 2013-14981 | A | 1/2013 |

OTHER PUBLICATIONS

Written Opinion of the International Search Authority for PCT/JP2015/077419, dated Dec. 8, 2015.

International Preliminary Report on Patentability issue for PCT/JP2015/077419, dated May 29, 2017.

European Search Report for EP Application No. 15882017.5, dated Oct. 5, 2018.

European Search Report for EP Application No. 15882017.5, dated Nov. 26, 2018.

* cited by examiner

ACTUATOR CONTROL DEVICE AND WORK VEHICLE

CROSS REFERENCE TO RELATED APPLICATIONS

This application is the U.S. National Phase of International Application No. PCT/JP2015/077419 filed Sep. 29, 2015, which claims the benefit of Japanese Patent Application No. 2015-026849 filed Feb. 13, 2015.

TECHNICAL FIELD

The present invention relates to an actuator control device that drives an actuator in accordance with an operation amount of an operation unit.

BACKGROUND ART

Work machines that operate in accordance with an operation of an operation lever, etc. by an operator have been conventionally known. For example, Patent Literature 1 discloses a work machine that controls a driving speed of an actuator that expands or contracts a raising and lowering cylinder, according to an operation amount of an operation lever designated by an operator. In addition, Patent Literature 1 discloses an interface that allows an operator to change a drive control characteristic representing a relationship between an operation amount of an operation lever and a driving speed of an actuator.

CITATION LIST

Patent Literature

[Patent Literature 1] Japanese Patent No. 4243329

SUMMARY OF INVENTION

Technical Problem

According to Patent Literature 1, a drive control characteristic is changed by an operator's operation of moving any point of a control characteristic curve displayed on a display unit in any direction. Although this method allows to achieve a high degree of freedom in changing a drive control characteristic, it has a problem that it requires complicated operations to obtain the desired drive control characteristic.

The present invention has been made in view of the above circumstances. The object of the present invention is to provide an actuator control device capable of obtaining the desired drive control characteristic with a simple operation.

Solution to Problem (1) An actuator control device according to the present invention includes an actuator, an operation unit that receives an operator's operation of driving the actuator, a storage unit that stores a drive control characteristic which is represented by a characteristic line monotonically increasing on a two-dimensional plane defined by a first axis which represents the operation amount of the operation unit and a second axis which is orthogonal to the first axis and represents the driving speed of the actuator, the drive control characteristic representing the driving speed corresponding to the operation amount, and a control unit that drives the actuator based on the drive control characteristic stored in the storage unit. The control unit performs a reception process in which designations of a minimum operation amount and maximum operation amount of the operation unit for driving the actuator, and a maximum driving speed which is the actuator driving speed corresponding to the maximum operation amount are received, a determination process in which a function representing a characteristic line that links a first point, which corresponds to the minimum operation amount and the driving speed of 0, and a second point, which corresponds to the maximum operation amount and the maximum driving speed, is stored in the storage unit as the drive control characteristic, and a drive control process in which, in response to operation of the operation unit, the actuator is driven at the driving speed corresponding to the operation amount specified by the drive control characteristic stored in the storage unit.

According to the constitution, it is possible to obtain a new drive control characteristic by designating the minimum operation amount, the maximum operation amount, and the maximum driving speed that specify the two points at both ends of a characteristic line. Also, it is possible to adjust the dead zone (or play) of an operation unit by increasing or decreasing the minimum operation amount. Further, it is possible to adjust the stroke of an operation unit by increasing or decreasing the minimum operation amount and the maximum operation amount. Furthermore, it is possible to control the driving speed of an actuator to the necessary minimum by increasing or decreasing the maximum driving speed, and thus possible to enhance safety. As such, the present invention allows an operator to designate only parameters that greatly affect operability and safety, thus enabling to obtain the desired drive control characteristic with a simple operation.

(2) Preferably, the characteristic line is a single straight line or a curve which does not include an inflection point.

When the characteristic line is a plurality of straight lines with different inclinations, or when the characteristic line is a curve having an inflection point, the tendency in the change of the actuator's driving speed greatly changes in the middle of it. This may cause the actuator to perform an operation not intended by the operator. Therefore, it is possible to prevent the actuator from performing an operation not intended by an operator, by adopting the characteristic line shape as described above.

(3) Preferably, the control unit receives designation of the shape of the characteristic line on a two-dimensional plane, in the reception process, and determines a function representing the characteristic line which links the first point and the second point to form the designated shape, as the drive control characteristic, in the determination process.

According to the constitution, the operator is allowed to designate the shape of the characteristic line, and thus it is possible to obtain a drive control characteristic desired by the operator.

(4) For example, the actuator is a hydraulic cylinder expanded and contracted by hydraulic oil supplied from a hydraulic pump. Also, in the drive control process, the driving speed controlled by the control unit is the flow rate per unit time of hydraulic oil passing through a switching valve disposed in an oil passage extending from the hydraulic pump to the hydraulic cylinder.

However, the type of the actuator is not limited to a hydraulic cylinder, and it may be a hydraulic motor, an electric motor, etc. When the actuator is an electric motor, for example, the driving speed is controlled by the magnitude of the driving current supplied to the electric motor.

(5) A work vehicle according to the present invention includes: a lower traveling body, an upper work body which operates supported by the lower traveling body, and an actuator control device according to any one of claims 1 to 4 for operating the upper work body.

According to the constitution, it is possible to obtain a work vehicle that can customize the operability of the upper work body for each operator.

Advantageous Effects of Invention

The present invention allows the operator to designate only parameters that greatly affect operability and safety, thus enabling to obtain a desired drive control characteristic with a simple operation.

BRIEF DESCRIPTION OF DRAWINGS

FIG. 7(A) shows a state where the line shape has been changed, and FIG. 7(B) shows a state where the minimum operation amount has been changed.

FIG. 8(A) shows a state where the maximum operation amount has been changed, and FIG. 8(B) shows a state where the maximum driving speed has been changed.

DETAILED DESCRIPTION

Description of Embodiments

Hereinafter, preferred embodiments of the present invention will be described with reference to the drawings where appropriate. It should be noted that these embodiments are only for illustrative purposes and various modifications may be made without departing from the scope of the invention.

[Rough Terrain Crane 10]

Figure 1:
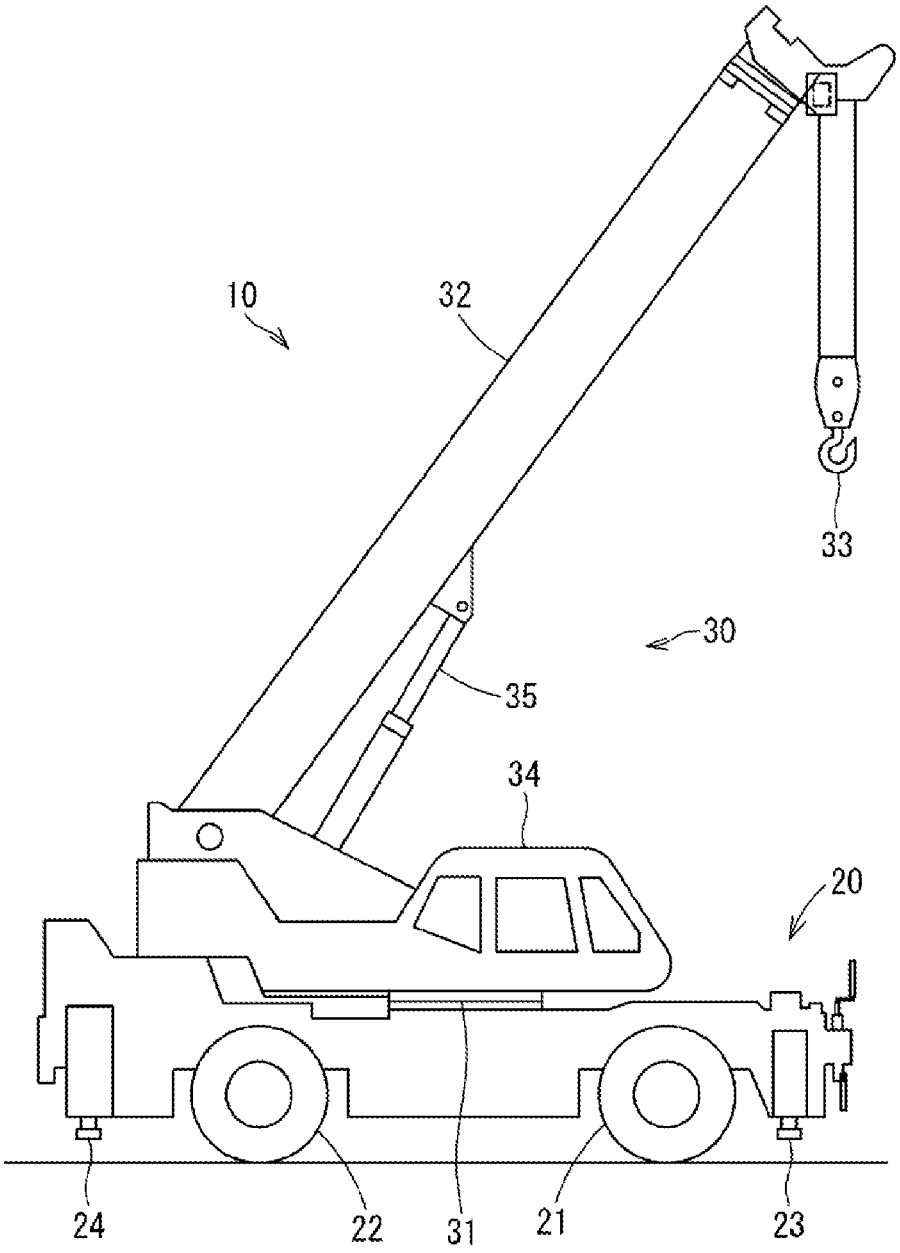
FIG. 1 is a schematic diagram of a rough terrain crane 10 according to the present embodiment.
Figure 2:
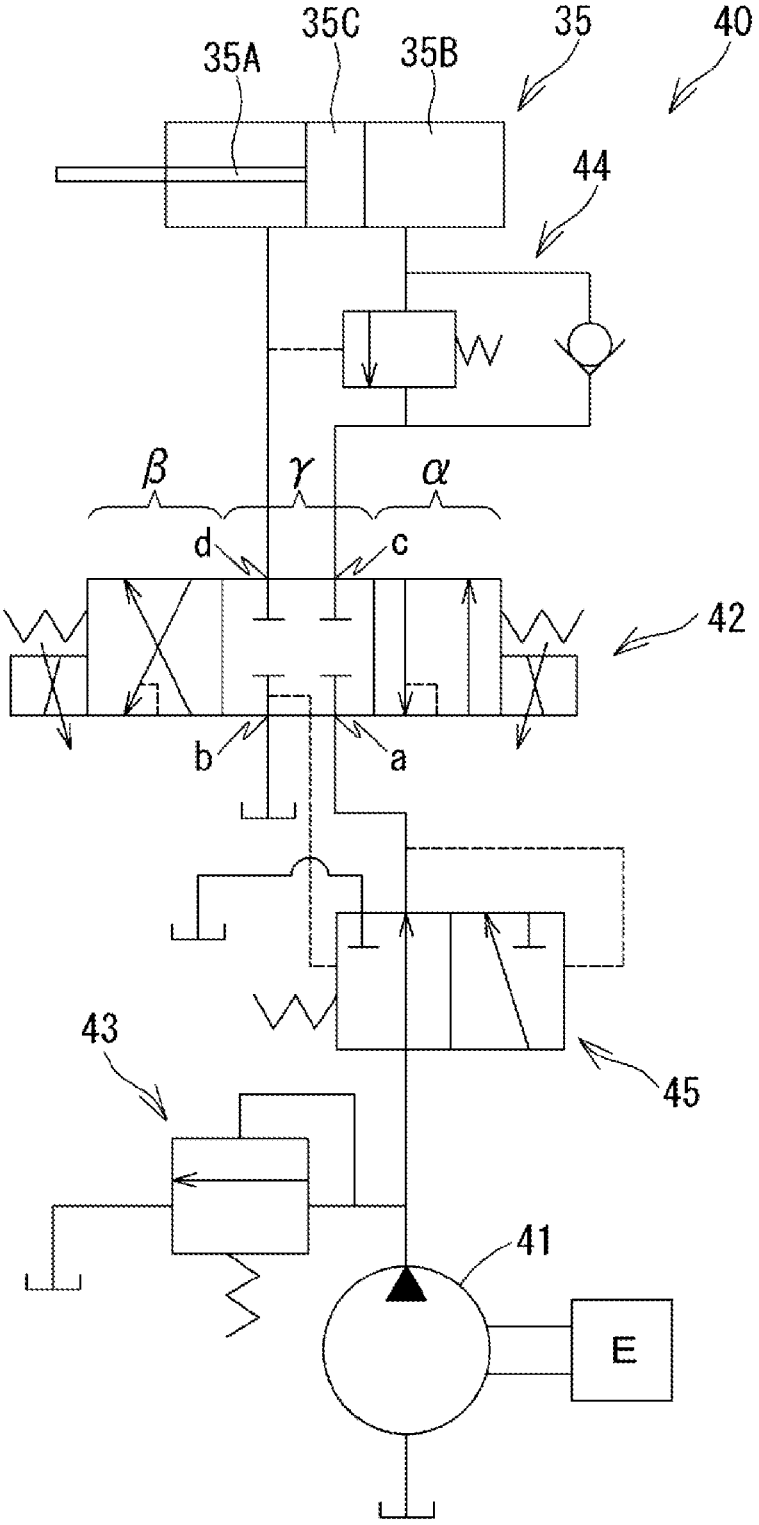
FIG. 2 is a hydraulic system diagram of the hydraulic actuator circuit 40 according to the present embodiment.

As shown in FIG. 1, the rough terrain crane 10 according to the present embodiment mainly includes a lower traveling body 20, an upper work body 30, and a hydraulic actuator circuit 40 (see FIG. 2). The rough terrain crane 10 is driven to a destination by the lower traveling body 20 and makes the upper work body 30 perform a predetermined operation at the destination. The rough terrain crane 10 is an example of the work vehicle. Specific examples of the work vehicle are not limited thereto. For example, it may be an all terrain crane, an aerial work vehicle, etc.

[Lower Traveling Body 20]

The lower traveling body 20 has a pair of left and right front wheels 21 and a pair of left and right rear wheels 22 (only the right side is shown in FIG. 1). The front wheels 21 and the rear wheels 22 are rotated by a driving force of an engine (not shown) transmitted through a transmission (not shown).

Further, the lower traveling body 20 has outriggers 23 and 24. The outriggers 23 and 24 are located at positions protruding from the lower traveling body 20 in the left-right direction. Thus, they can change their state between an overhanging state in which they are in contact with the ground and a storage state in which they are distant from the ground and stored in the lower traveling body 20. It is possible to stabilize the position of the rough terrain crane 10 by putting the outriggers 23 and 24 in the overhanging state during operation of the upper working body 30. On the other hand, the outriggers 23 and 24 are in the storage state while the lower traveling body 20 is traveling.

[Upper Work Body 30]

Figure 3:
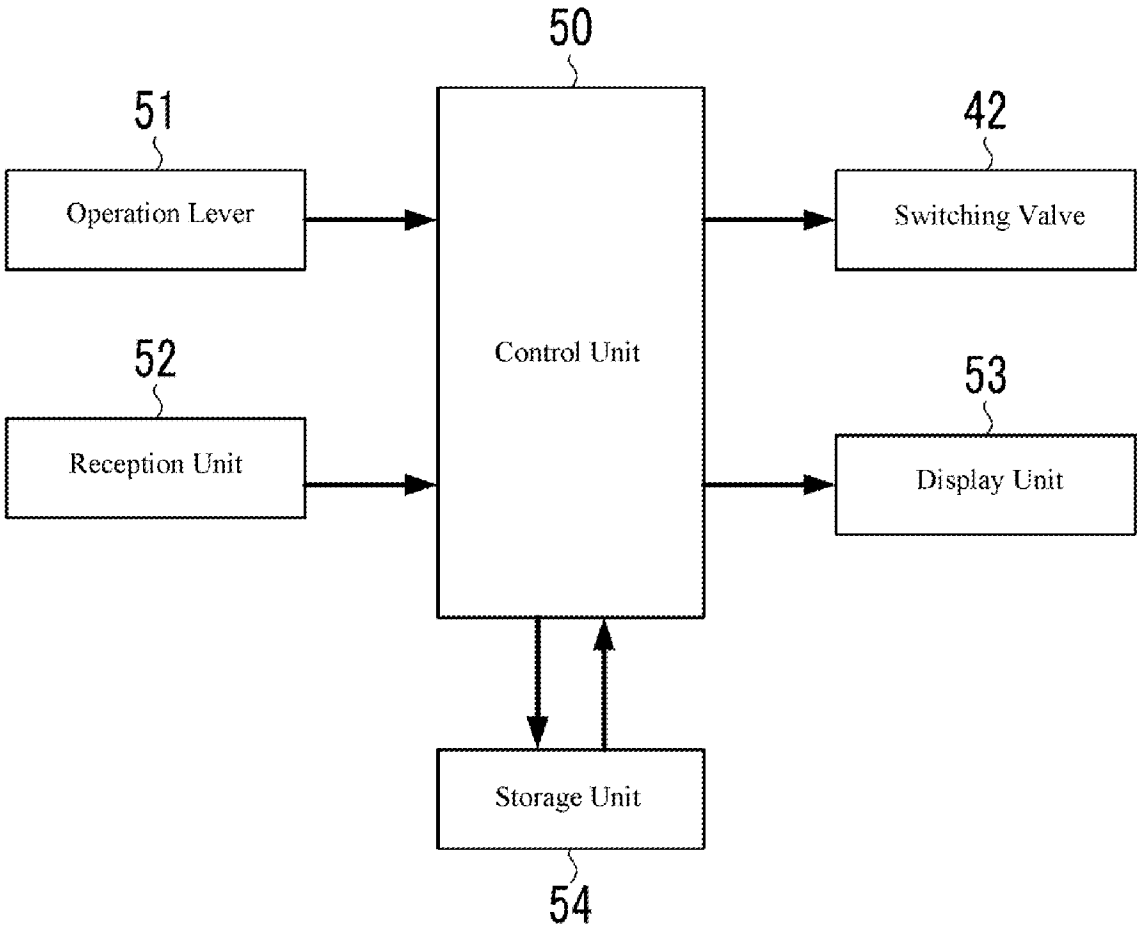
FIG. 3 is a functional block diagram of the rough terrain crane 10.

The upper working body 30 is rotatably supported on the lower traveling body 20 via a pivot bearing 31. The upper work body 30 mainly includes a telescopic boom 32, a hook 33, and a cabin 34. The telescopic boom 32 is raised and lowered by the raising and lowering cylinder 35, and is expanded and contracted by a telescopic cylinder (not shown). The hook 33 is suspended from the distal end of the telescopic boom 32 and raised and lowered by a winch (not shown). The cabin 34 is provided with an operation lever 51, a reception unit 52, and a display unit 53 as shown in FIG. 3.

[Hydraulic Actuator Circuit 40]

As shown in FIG. 2, the hydraulic actuator circuit 40 mainly includes a hydraulic pump 41, a switching valve 42, a relief valve 43, a counter balance valve 44, a flow rate control valve 45, and a raising and lowering cylinder 35. The hydraulic actuator circuit 40 raises and lowers the telescopic boom 32 under the control of a control unit 50 (see FIG. 3) to be described later. The raising and lowering cylinder 35 is an example of the actuator and the hydraulic cylinder. The hydraulic actuator circuit 40, the operation lever 51, and the control unit 50 are examples of the actuator control device.

The hydraulic pump 41 supplies hydraulic oil to the raising and lowering cylinder 35. The hydraulic pump 41 is driven by the transmitted driving force of the engine E. The raising and lowering cylinder 35 is expanded and contracted by the hydraulic oil supplied from the hydraulic pump 41. More specifically, the raising and lowering cylinder 35 is expanded by the supply of hydraulic oil to the first chamber 35A and the discharge of hydraulic oil from the second chamber 35B, and contracted by the discharge of hydraulic oil from the first chamber 35A.

The switching valve 42 is disposed in an oil passage extending from the hydraulic pump 41 to the raising and lowering cylinder 35, and switches the direction and the flow rate of the hydraulic oil. The switching valve 42 is a switching type electromagnetic proportional valve with four ports (a, b, c, d) and three positions (position $\alpha$, position $\beta$, position $\gamma$). Further, the switching valve 42 is a variable capacity valve capable of adjusting the flow rate of the hydraulic oil to be passed. Port a is connected to the hydraulic pump 41, port b is connected to the tank, port c is connected to the first chamber 35A of the raising and lowering cylinder 35, and port d is connected to the second chamber 35 B of the raising and lowering cylinder 35.

The switching valve 42 at position $\alpha$ supplies hydraulic oil to the first chamber 35 A of the raising and lowering cylinder 35 and returns the hydraulic oil discharged from the second chamber 35 B of the raising and lowering cylinder 35 to the tank. Further, the switching valve 42 at position $\beta$ supplies hydraulic oil to the second chamber 35 B of the raising and lowering cylinder 35, and returns the hydraulic oil discharged from the first chamber 35A of the raising and lowering cylinder 35 to the tank. Further, the switching valve 42 at position $\alpha$ holds the piston 35C of the raising and lowering cylinder 35 at the position just before switching occurs. The position and the flow rate of the switching valve 42 are controlled by the control unit 50.

The relief valve 43 prevents the hydraulic pressure of the hydraulic actuator circuit 40 from excessively increasing due to the hydraulic oil supplied from the pump 41. The counter balance valve 44 controls the amount of the hydraulic oil discharged from the first chamber 35A of the raising and lowering cylinder 35 to prevent abrupt contraction of the telescopic boom 32 due to its own weight. The flow rate control valve 45 controls the flow rate of the hydraulic oil supplied from the pump 41 to the switching valve 42. Specifically, the flow rate of the hydraulic oil passing through the flow rate control valve 45 is controlled so as to satisfy the condition of the hydraulic pressure of port a=the hydraulic pressure of port b+ the spring pressure of the flow rate control valve 45.

[Control Unit 50]

The control unit 50 controls the operation of the hydraulic actuator circuit 40. The control unit 50 may be embodied into, for example, a CPU (Central Processing Unit) that reads out and executes a program stored in the storage unit 54, a hardware circuit, or into a combination thereof. As shown in FIG. 3, the control unit 50 is connected to the operation lever 51, the reception unit 52, the switching valve 42, the display unit 53, and the storage unit 54.

Figure 4:
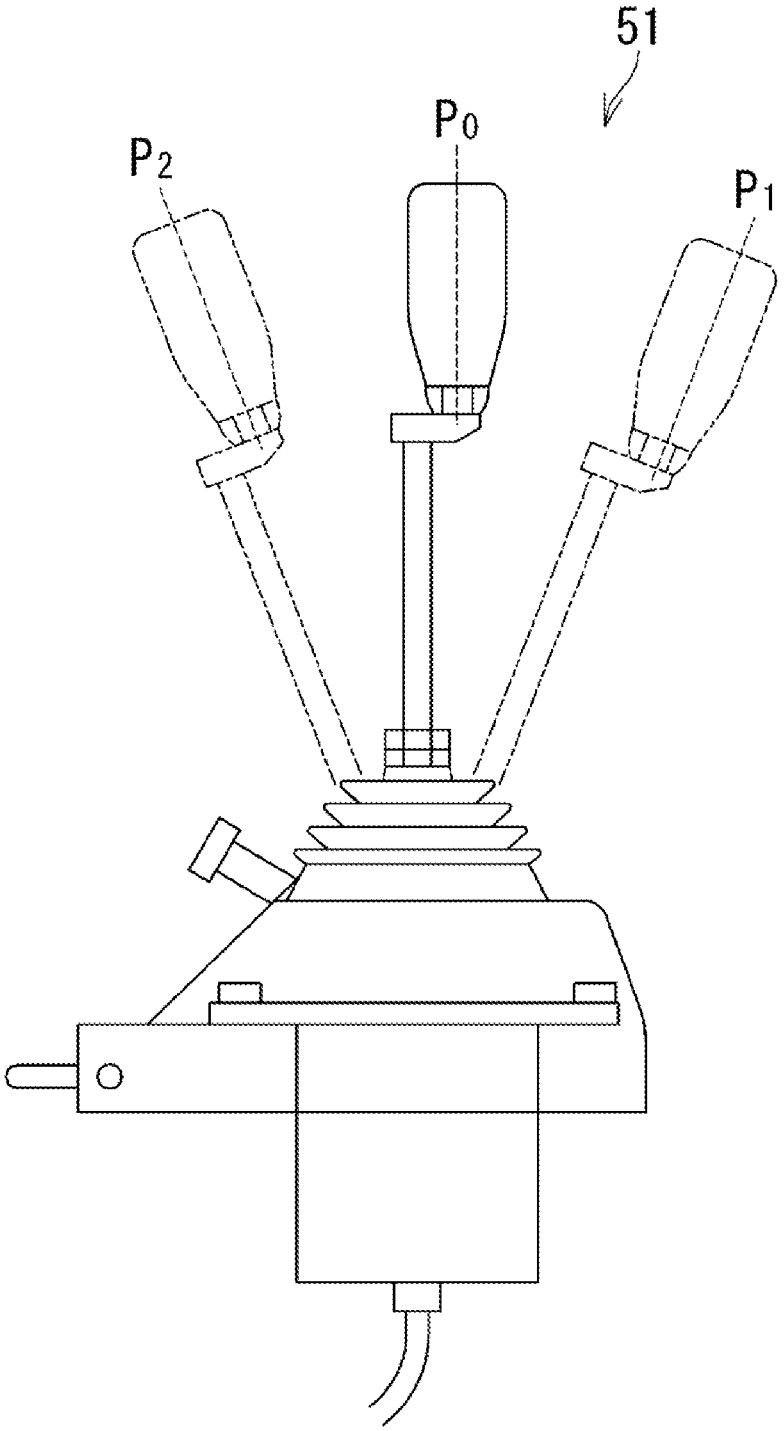
FIG. 4 is a schematic diagram of the operation lever 51.
Figure 5:
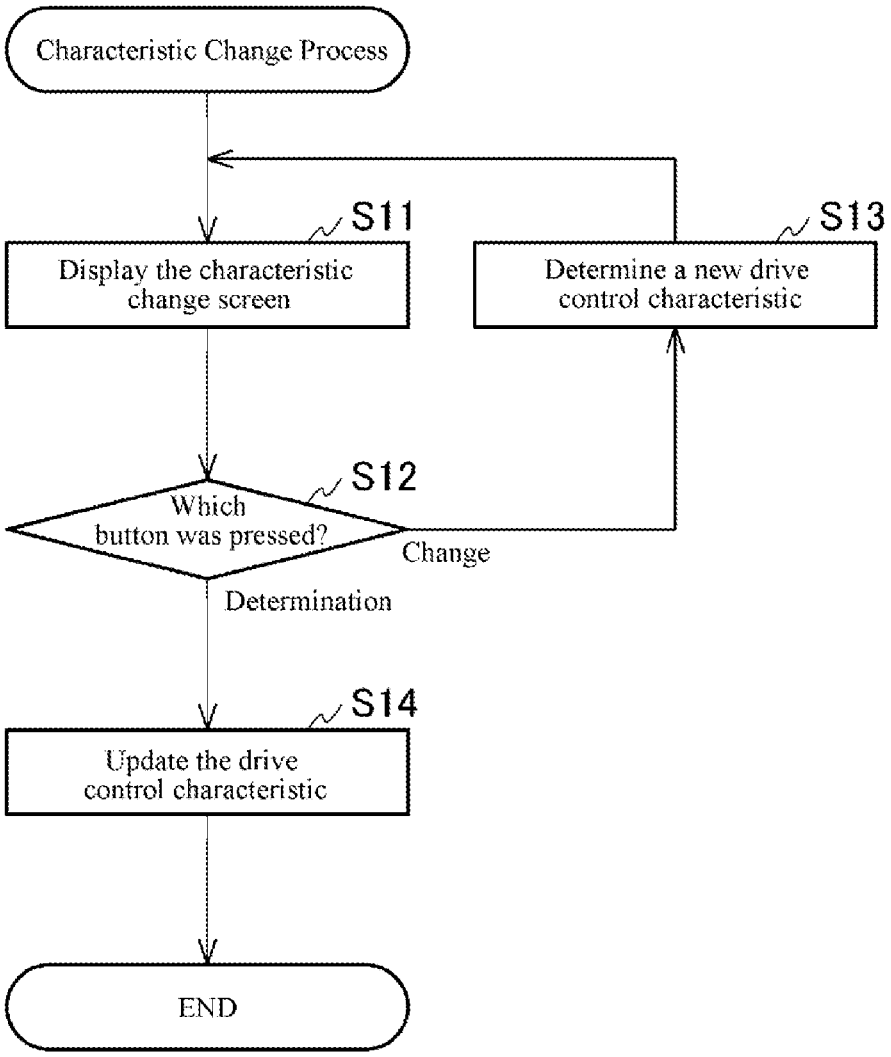
FIG. 5 is a flowchart of the characteristic change process.

The operation lever 51 receives an operator's operation of expanding and contracting the raising and lowering cylinder 35. The control unit 50, for example, moves the switching valve 42 to position α in response to falling of the operation lever 51 from the neutral position P0 as shown in FIG. 4 toward the first position P1. Further, the control unit 50 moves the switching valve 42 to position β in response to falling of the operation lever 51 from the neutral position P0 toward the second position P2. Also, the control unit 50 positions the switching valve 42 at position α in response to positioning the operation lever 51 at the neutral position P0 as shown in FIG. 4.

The operation lever 51 outputs an operation signal corresponding to an operator's operation to the control unit 50. In the present embodiment, the operation lever 51 at the neutral position P0 does not output an operation signal. On the other hand, the operating lever 51 that is not in the neutral position P0 outputs an operation signal according to the operation direction (falling direction) and the operation amount (falling angle). The operation lever 51 is an example of the operation unit. However, specific examples of the operation unit are not limited to the operation lever 51. It may be any device capable of continuously changing the operation amount, such as a pedal, etc.

The reception unit 52 receives various designations given by the operator, in the characteristic change process to be described later. The display unit 53 is a display for displaying the state of the rough terrain crane 10 (in particular, the hydraulic actuator circuit 40). For example, the reception unit 52 may be a touch sensor superimposed on the display unit 53. That is, the reception unit 52 and the display unit 53 may be so-called touch panel displays. For example, the reception unit 52 and the display unit 53 may also serve as an interface of an AML (overload prevention device) generally mounted on the rough terrain crane 10.

The storage unit 54 stores a program executed by the control unit 50 and a drive control characteristic used in the drive control process to be described later. The drive control characteristic shows the correspondence between the operation amount of the operation lever 51 and the flow rate per unit time of the hydraulic oil passing through the switching valve 42. For example, the drive control characteristic is stored in the storage unit 54 in the form of a function representing a characteristic line on a two-dimensional plane defined by an x-axis representing the operation amount (0-100%) of the operation lever 51 and a y-axis representing the flow rate (0-100%) per unit time of hydraulic oil. The x-axis is an example of the first axis and the y-axis is an example of the second axis orthogonal to the first axis. Further, the flow rate per unit time of hydraulic oil (hereinafter simply referred to as "flow rate") is an example of the driving speed of the actuator.

Figure 6:
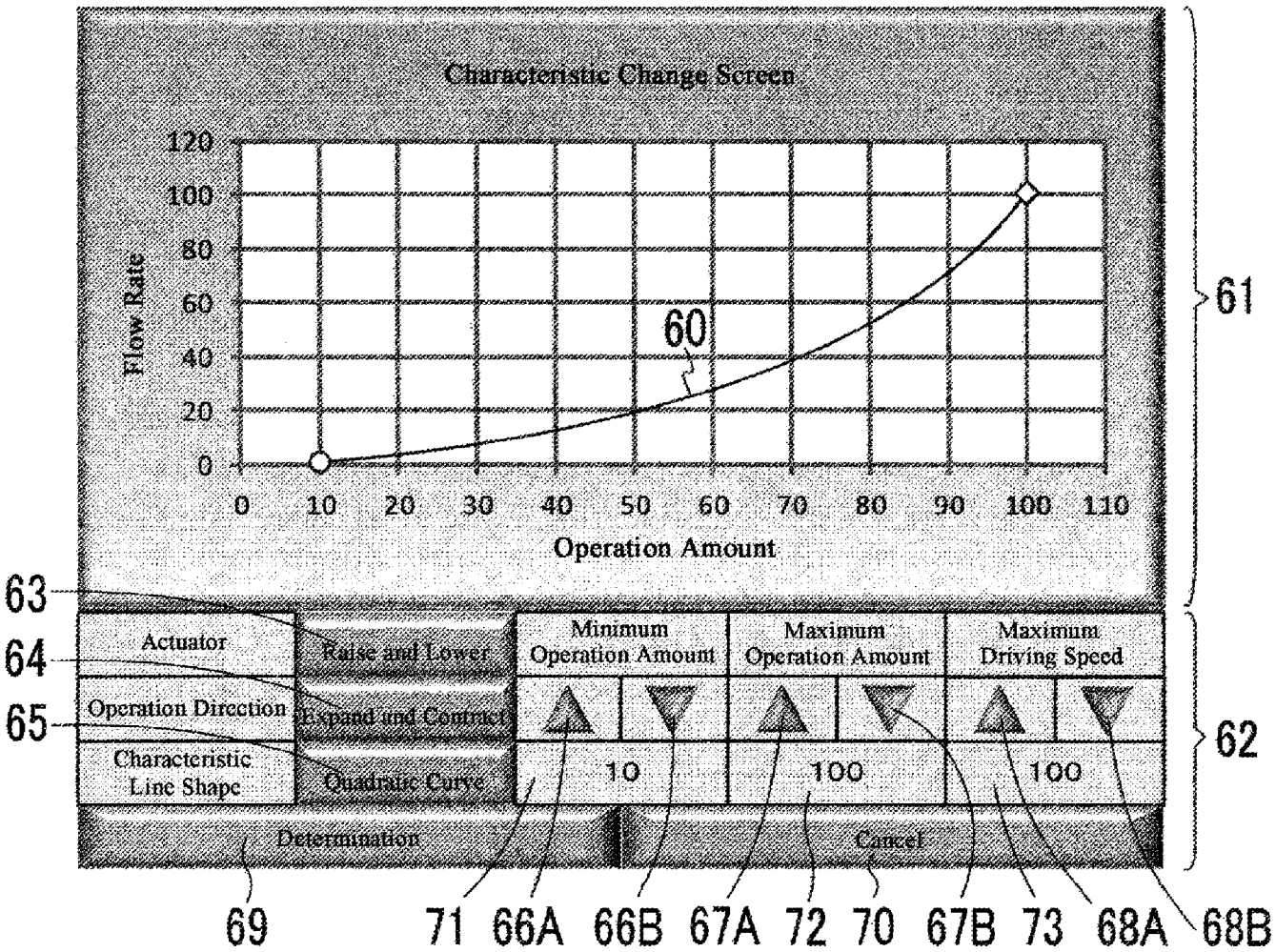
FIG. 6 is a diagram showing a display example of a characteristic change screen.
Figure 7:
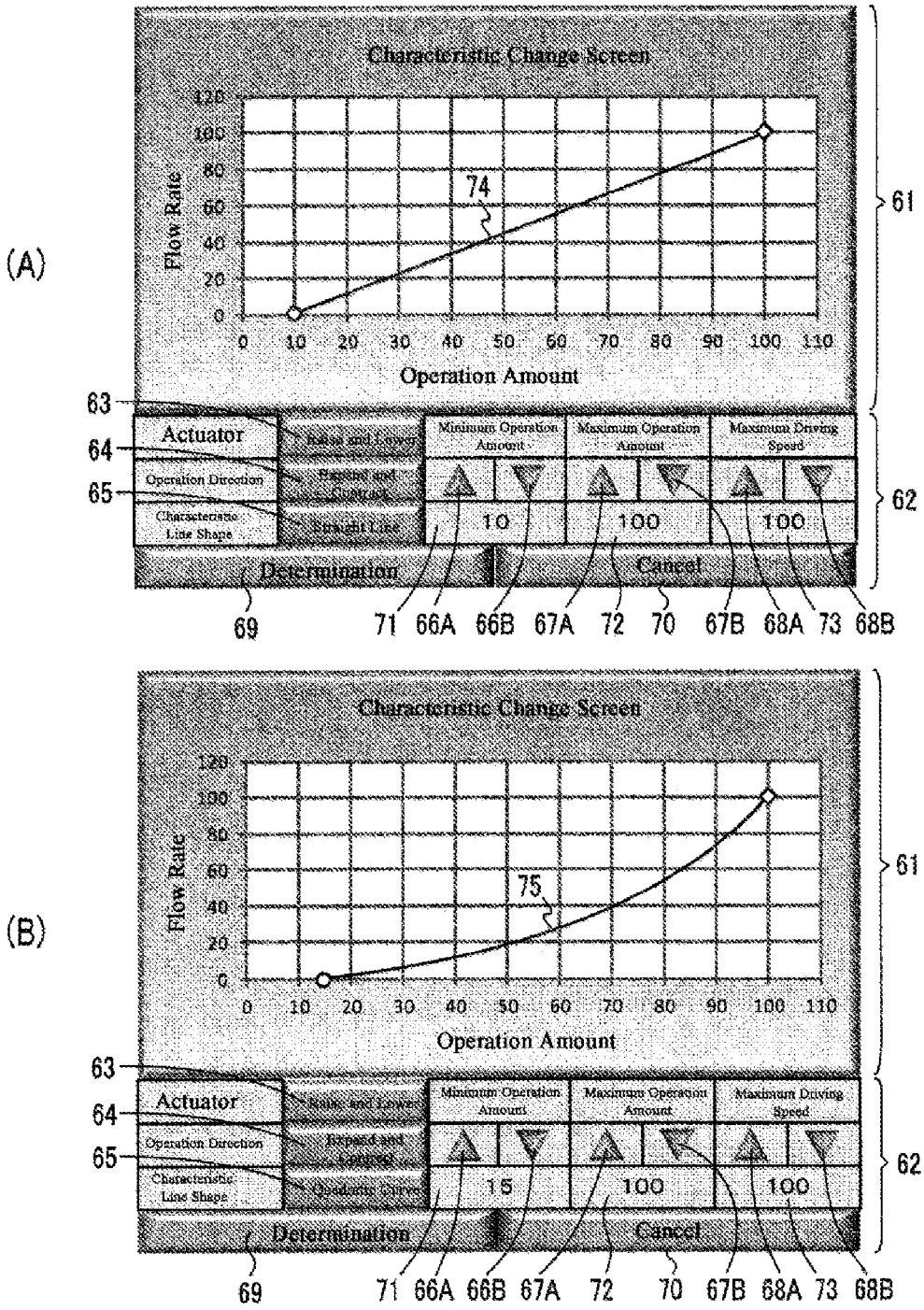
FIG. 7 is a display example of a characteristic change screen.
Figure 8:
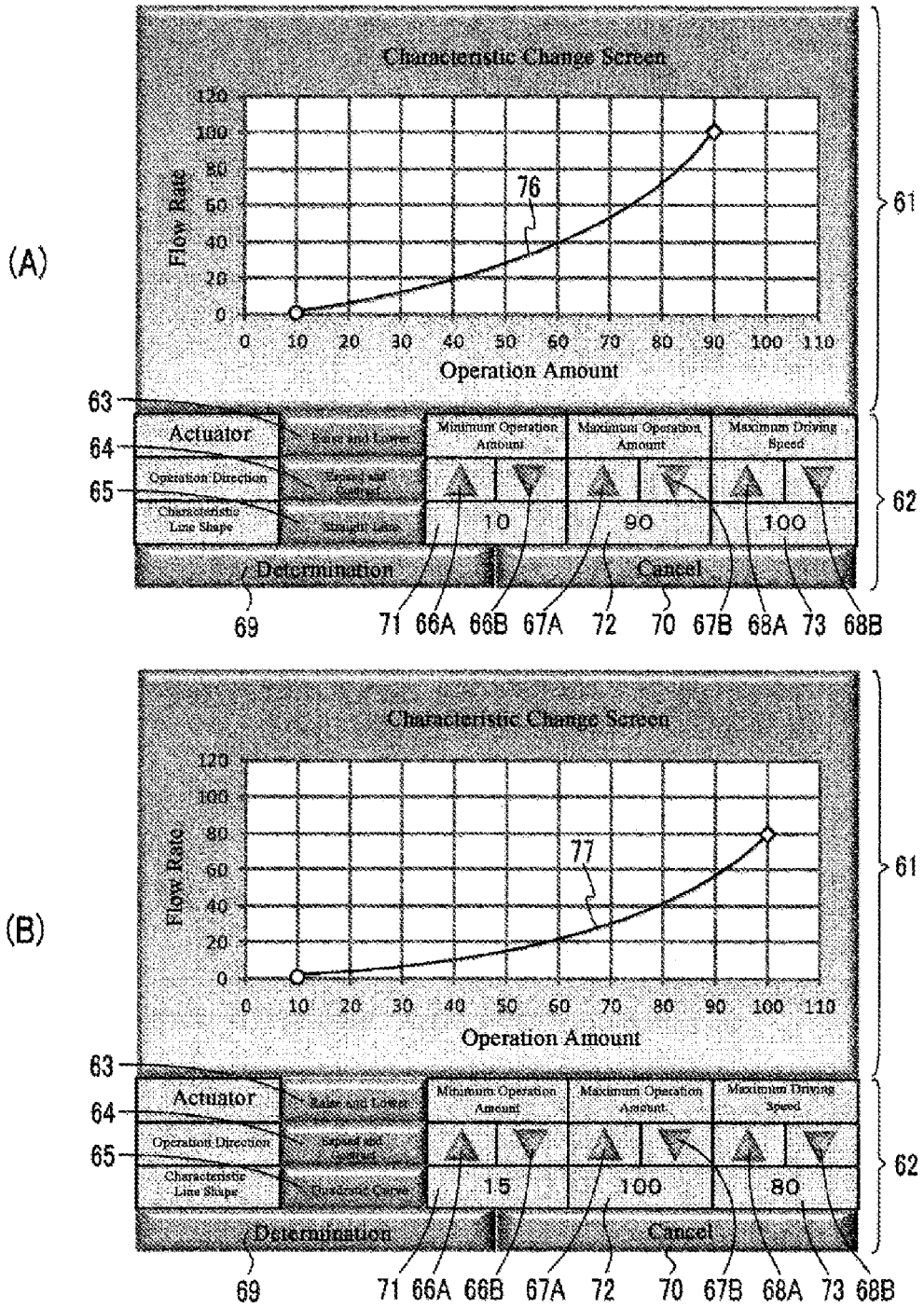
FIG. 8 is a display example of a characteristic change screen.

FIG. 6 shows an example of the drive control characteristic when expanding the raising and lowering cylinder 35. The operation amount shown in FIG. 6 is expressed as a ratio when the physical maximum falling angle of the operation lever 51 is taken as 100%. Similarly, the flow rate shown in FIG. 6 is expressed as a ratio when the physical maximum flow rate through the switching valve 42 is taken as 100%. Also, in response to falling of the control lever 51 from the neutral position P0 to the first position P1, the control unit 50 specifies the flow rate of hydraulic oil corresponding to the falling angle based on the characteristic line 60 and adjusts the opening degree of the switching valve 42 so that hydraulic oil passes through the switching valve 42 at position α at the specified flow rate. This process is an example of the drive control process.

It should be noted that a plurality of drive control characteristics may be stored in the storage unit 54. For example, the following drive control characteristics may be stored separately: the drive control characteristic when expanding the raising and lowering cylinder 35, the drive control characteristic when contracting the raising and lowering cylinder 35, the drive control characteristic when expanding the telescopic cylinder, the drive control characteristic when contracting the telescopic cylinder, the drive control characteristics when winding a rope onto the winch, the drive control characteristics when feeding a rope from the winch, the drive control characteristic when rotating the upper work body 30 to the right, and the drive control characteristic when rotating the upper work body 30 to the left. However, some or all of the drive control characteristics described above may overlap.

[Characteristic Change Process]

Characteristic change process will be described with reference to FIG. 5 to FIG. 8 below. The characteristic change process is a process of changing the drive control characteristic stored in the storage unit 54 according to an instruction of an operator. The characteristic change process is executed by the control unit 50.

First, the control unit 50 causes the display unit 53 to display the characteristic change screen as shown in FIG. 6 (S11). The characteristic change screen is a screen for displaying the current drive control characteristic and receiving an operator's operation of changing the drive control characteristic. The characteristic change screen shown in FIG. 6 includes a characteristic display area 61 including the characteristic line 60 and a reception area 62 including various buttons 63 to 70, etc.

The characteristic line 60 displayed in the characteristic display area 61 represents the drive control characteristic stored in the storage unit 54. The characteristic line 60 is a quadratic curve connecting the first point and the second point. The first point (x, y)=(minimum operation amount, 0) and the second point (x, y)=(maximum operation amount, maximum driving speed). The characteristic line is an at least monotonically increasing line, preferably a single straight line or a curve that does not include an inflection point.

The minimum operation amount refers to the minimum operation amount of the operation lever 51 required for driving the raising and lowering cylinder 35. In other words, when the operation amount of the operation lever 51 is less than the minimum operation amount (0%-10% in the example of FIG. 6), the switching valve 42 does not move from position γ. The operation amount less than the minimum operation amount corresponds to the dead zone (or play).

The maximum operation amount refers to maximum falling angle of the operation lever 51 required for switching the switching valve 42 to the maximum switching amount (when the setting of the maximum driving speed is changed, the maximum switching amount of the switching valve 42 after the change, which will be described later). In other words, if the maximum operation amount (90% in the example of FIG. 8(A)) is set, the switching valve 42 switches to the maximum switching amount in accordance with the set maximum operation amount, and even if the operation lever 51 is operated to exceed the maximum operation amount, the opening degree of the switching valve 42 does not change. It is possible to change the operation stroke of the operation lever 51 at the time of switching the switching valve 42 to the maximum switching amount, according to the preference and arbitrarily, by setting the maximum operation amount.

The maximum driving speed refers to the maximum opening degree of the switching valve 42 when the operating lever 51 is maximally operated. In other words, if the maximum driving speed (80% in the example of FIG. 8(B)) is set, even if the operating lever 51 is maximally operated, the switching amount of the switching valve 42 is controlled so that it does not exceed the set maximum opening degree. It is possible to change the maximum switching amount of the switching valve 42 arbitrarily when the operating lever 51 is maximally operated, as needed, by setting the maximum driving speed.

The reception area 62 includes an actuator switching button 63, a movement direction switching button 64, a characteristic line shape switching button 65, [Δ] buttons 66 A, 67 A and 68 A, [∇] buttons 66 B, 67 B and 68 B, a determination button 69, a cancel button 70, a minimum operation amount display area 71, a maximum operation amount display area 72, and a maximum driving speed display area 73.

The actuator switching button 63 is a button for switching an actuator whose drive control characteristic is to be changed. A character string representing the selected actuator is added to the actuator switching button 63. For example, each time when the actuator switching button 63 is pressed, the actuator whose drive control characteristic is to be changed switches in the following order: the raising and lowering cylinder 35, the telescopic cylinder, the winch, and then swing motor.

The operation direction switching button 64 is a button for switching an operation direction which is a drive control characteristic to be changed in an actuator selected by the actuator switching button 63. A character string representing the selected operation direction is added to the operation direction switching button 64. For example, each time when the operation direction switching button 64 which selected the raising and lowering cylinder 35 is pressed, the operation direction as a drive control characteristic to be changed switches in the following order: expansion direction and then contraction direction.

The characteristic line shape switching button 65 is a button for switching the shape of the characteristic line 60 connecting the first point and the second point. A character string representing the selected line shape is added to the characteristic line shape switching button 65. For example, each time when the characteristic line shape switching button 65 is pressed, the shape of the characteristic line 60 switches in the following order: a straight line and then a quadratic curve.

The [Δ] buttons 66A, 67A, and 68A respectively are buttons for increasing the minimum operation amount, the maximum operation amount, and the maximum driving speed by 1% at a time. The [∇] buttons 66B, 67B, and 68B respectively are buttons for decreasing the minimum operation amount, the maximum operation amount, and the maximum driving speed by 1% at a time. The determination button 69 is a button for fixing the change of the drive control characteristic. The cancel button 70 is a button for canceling the change of the drive control characteristic. The minimum operation amount display area 71, the maximum operation amount display area 72, and the maximum driving speed display area 73 respectively displays the current values of the minimum operation amount, the maximum operation amount, and of the maximum driving speed.

Next, the control unit 50 stands by in a state where it can receive an operator's operation of pressing various buttons 63 to 70 through the reception unit 52 (S12). The process of the step (S12) is an example of the reception process. Then, in response to pressing of the characteristic line shape switching button 65, [Δ] buttons 66 A to 68 A or [∇] buttons 66 B to 68 B (S12: change), the control unit 50 determines a new driving control characteristic (S13). Hereinafter, specific processes will be described which are conducted when the characteristic line shape switching button 65, [Δ] button 66A, [∇] button 67B and [∇] button 68B on the characteristic change screen as shown in FIG. 6 are pressed.

When the characteristic line shape switching button 65 shown in FIG. 6 is pressed once (S12: change), the control unit 50 determines a function representing a straight line connecting the first point and the second point as a new drive control characteristic (S13). Also, the control unit 50 temporarily stores the drive control characteristic in the storage unit 54, in addition to the drive control characteristic used in the drive control process. Further, as shown in FIG. 7(A), the control unit 50 causes the display unit 53 to display a characteristic change screen including the characteristic line 74 representing the drive control characteristic determined in step S13 (S 11). The process of step S13 is an example of the determination process. Pressing the characteristic line shape switching button 65 is an example of designation of the shape of the characteristic line on a two-dimensional plane.

In response to pressing the [A] button 66A as shown in FIG. 6 five times (S12: change), the control unit 50 determines a function representing a quadratic curve connecting the first point (15, 0) and the second point (100, 100) as a new drive control characteristic, and temporarily stores the drive control characteristic in the storage unit 54 (S13). Further, as shown in FIG. 7(B), the control unit 50 causes the display unit 53 to display a characteristic change screen including the characteristic line 75 representing the drive control characteristic determined in step S13 (S11). The characteristic line 75 as shown in FIG. 7(B) is an example of the drive control characteristic determined in response to designation of the minimum operation amount=15%, maximum operation amount=100%, and maximum driving speed=100%.

In response to pressing the [∇] button 67 B as shown in FIG. 6 ten times (S12: change), the control unit 50 determines a function representing a quadratic curve connecting the first point (10, 0) and the second point (90, 100) as a new drive control characteristic, and temporarily stores the drive control characteristic in the storage unit 54 (S13). Further, as shown in FIG. 8(A), the control unit 50 causes the display unit 53 to display a characteristic change screen including the characteristic line 76 representing the drive control characteristic determined in step S13 (S11). The characteristic line 76 shown in FIG. 8(A) is an example of the drive control characteristic determined in response to designation of the minimum operation amount=10%, the maximum operation amount=90% and the maximum driving speed=100%.

In response to pressing the [∇] button 68B as shown in FIG. 6 twenty times (S12: change), the control unit 50 determines a function representing a quadratic curve connecting the first point (10, 0) and the second point (100, 80) as a new drive control characteristic, and temporarily stores the drive control characteristic in the storage unit 54 (S13). Further, as shown in FIG. 8(B), the control unit 50 causes the display unit 53 to display a characteristic change screen including the characteristic line 77 representing the drive control characteristic determined in step S13 (S11). The characteristic line 77 shown in FIG. 8(B) is an example of the drive control characteristic determined in response to designation of the minimum operation amount=10%, maximum operation amount=100%, and maximum driving speed=80%.

On the other hand, in response to pressing the determination button 69 as shown in FIG. 6 (S12: determination), the control unit 50 stores a function representing the characteristic line 60 displayed in the characteristic display area (in other words, temporarily stored in the storage unit 54) in the storage unit 54 as a new drive control characteristic for expanding the raising and lowering cylinder 35 (S14). That is, in step S14, the control unit 50 overwrites the drive control characteristic stored in the storage unit 54 with the new drive control characteristic determined in step S13. Then, when the operation lever 51 is operated, the control unit 50 adjusts the opening degree of the switching valve 42 according to the new drive control characteristic.

Also, although not shown, in response to pressing the cancel button 70, the control unit 50 cancels the change operation performed up to this point and terminates the characteristic change process. Further, although not shown, in response to pressing the actuator switching button 63 or the operation direction switching button 64 (S11), the control unit 50 displays a characteristic line representing the corresponding operation control characteristic on the characteristic change screen (S11).

Effects of the Present Embodiment

According to the embodiment, a new drive control characteristic can be obtained by allowing the operator to designate the minimum operation amount, the maximum operation amount, and the maximum driving speed that define the two points at both ends of the characteristic line. Also, it is possible to adjust the dead zone (or play) of the operation unit by increasing or decreasing the minimum operation amount. Further, the stroke of the operation lever 51 can be adjusted by increasing or decreasing the minimum operation amount and the maximum operation amount. Further, it is possible to control the driving speed of the raising and lowering cylinder 35 to the necessary minimum by increasing or decreasing the maximum driving speed, and thus possible to enhance safety. As such, the present embodiment allows the operator to designate only parameters that greatly affect operability and safety, thus enabling to obtain the desired drive control characteristic with a simple operation.

Further, the embodiment allows the operator to designate the shape of the characteristic line, thus enabling to obtain a drive control characteristic satisfying the preference of the operator. For example, when a straight line is selected, a change in the driving speed in response to a change in the operation amount is constant over the entire stroke of the operation lever 51. In another example, when a quadratic curve is selected, the rate of change of the driving speed increases as the operation amount increases. However, the shape of the characteristic line is not limited thereto.

In addition, when the characteristic line is a plurality of straight lines with different inclinations, or when the characteristic line is a curve having an inflection point, the tendency in the change of the driving speed of the raising and lowering cylinder 35 greatly changes in the middle of it. This may cause the raising and lowering cylinder 35 to perform an operation not intended by the operator. Therefore, it is possible to prevent the raising and lowering cylinder 35 from performing an operation not intended by the operator, by adopting the characteristic line shape as described above.

Further, the storage unit 54 may store a plurality of drive control characteristics for expanding the raising and lowering cylinder 35. Also, the control unit 50 may expand the raising and lowering cylinder 35 according to a drive control characteristic designated by the operator among the plurality of drive control characteristics. Thus, it is possible to obtain the rough terrain crane 10 that allows to customize the operability of the upper work body 30 for each operator. This also applies to the telescopic cylinder, the winch, and the swing motor.

The method of designating the minimum operation amount, maximum operation amount, and maximum driving speed on the characteristic change screen is not limited to the above examples. For example, in FIG. 6, the minimum operation amount may be designated by dragging the symbol amount, indicates the first point, from side to side, the maximum operation amount may be designated by dragging the symbol ◇, which indicates the second point, from side to side, and the maximum driving speed may be designated by dragging the symbol ◇, which indicates the second point, up and down.

Further, the parameters for determining the drive control characteristic are not limited only to the minimum operation amount, the maximum operation amount, and the maximum driving speed. For example, the operator may designate an intermediate point between the first point and the second point. Then, in step S13, the control unit 50 may determine a function representing the characteristic line passing through the first point, the intermediate point, and the second point as the drive control characteristic. Further, the shape of the characteristic line may be different between the area from the first point to the intermediate point and the area from the intermediate point to the second point.

Further, the type of the actuator is not limited to a hydraulic cylinder, and it may be a hydraulic motor, an electric motor, etc. When the actuator is an electric motor, the driving speed is controlled, for example, by the magnitude of the driving current supplied to the electric motor.

REFERENCE SIGNS LIST

10: Rough terrain crane
20: Lower traveling body

30: Upper work body
35: Raising and lowering cylinder
41: Hydraulic pump
42: Switching valve
50: Control unit
51: Operation lever
54: Storage unit

The invention claimed is:

1. An actuator control device comprising:

an actuator, an input device configured to provide a continuously variable signal in response to an operator's operation of driving the actuator, a memory device that stores a drive control characteristic which is represented by a characteristic line monotonically increasing on a two-dimensional plane defined by a first axis which represents the operation amount of the input device and a second axis which is orthogonal to the first axis and represents the driving speed of the actuator, the drive control characteristic representing the driving speed corresponding to the operation amount, and a computer processor configured to drive the actuator based on the drive control characteristic stored in the memory device, wherein the computer processor performs:

a first reception process in which inputs of values of a minimum operation amount and a maximum operation amount of the input device on the first axis for driving the actuator, and a value of a maximum driving speed on the second axis, which is the actuator driving speed corresponding to the maximum operation amount, are received, a second reception process in which designations of the shape of the characteristic line are received, a determination process in which the computer processor determines a function representing a characteristic line that links a first point, which corresponds to the minimum operation amount and the driving speed of 0, and a second point, which corresponds to the maximum operation amount and the maximum driving speed to form the designated shape, and stores the function in the memory device as the drive control characteristic, a drive control process is performed in which, in response to operation of the input device, the actuator is driven at the driving speed corresponding to the operation amount specified by the drive control characteristic stored in the memory device, and the characteristic line which is designated in the second reception process is limited to the group consisting of a single straight line and a curve which does not include an inflection point.

2. The actuator control device according to claim 1, wherein the actuator is a hydraulic cylinder expanded and contracted by hydraulic oil supplied from a hydraulic pump, and in the drive control process, the driving speed controlled by the computer processor is the flow rate per unit time of hydraulic oil passing through a switching valve disposed in an oil passage extending from the hydraulic pump to the hydraulic cylinder.

3. A work vehicle comprising:

a lower traveling body, an upper work body which operates supported by the lower traveling body, and an actuator control device according to claim 1 for operating the upper work body.

* * * * *